United States Patent [19]

Trunley et al.

[11] 4,146,399

[45] Mar. 27, 1979

[54] PREPARATION OF PHOTOGRAPHIC MATERIAL

[75] Inventors: Roy Trunley, Rayleigh; Howard R. Hopwood, Chelmsford, both of England

[73] Assignee: Ciba-Geigy AG, Basel, Switzerland

[21] Appl. No.: 876,448

[22] Filed: Feb. 9, 1978

[30] Foreign Application Priority Data

Feb. 18, 1977 [GB] United Kingdom ..... 6856/77

[51] Int. Cl.[2] ..... G03C 1/84; G03C 1/40

[52] U.S. Cl. ..... 96/82; 96/84 R; 96/100 R; 96/107; 96/109; 96/111; 96/114.5; 96/120; 96/130; 427/414; 106/135; 106/309; 252/314; 252/318

[58] Field of Search ..... 96/100, 97, 130, 109, 96/107, 84 R, 111, 82, 114.5

[56] References Cited

U.S. PATENT DOCUMENTS

| | | | |
|---|---|---|---|
| 3,158,482 | 11/1964 | Lucas | 96/66.2 |
| 3,287,134 | 11/1966 | Kainrath et al. | 96/77 |
| 3,660,101 | 5/1972 | Owens et al. | 96/120 |
| 3,676,147 | 7/1972 | Boyer et al. | 96/132 |
| 4,006,025 | 2/1977 | Swank et al. | 96/129 |

*Primary Examiner*—J. Travis Brown

*Attorney, Agent, or Firm*—Sprung, Felfe, Horn, Lynch & Kramer

[57] ABSTRACT

Photographic additives in particular water-insoluble photographic additives are rendered easier to incorporate into photographic layers by finely dividing them, mixing them with a finely divided water soluble substance and compressing the resulting mixture into the form of a tablet. The tablets which contain from about 1 to 50% by weight of the photographic additives are then dissolved in the coating composition and this disperses the water insoluble additive uniformly throughout the coating composition.

21 Claims, No Drawings

PREPARATION OF PHOTOGRAPHIC MATERIAL

This invention relates to a process for the production of photographic silver halide material.

Usually it is required to incorporate various additives into photographic layers and in particular silver halide emulsion layers and these additives are very often water insoluble. The conventional method of incorporating water insoluble additives for example optical sensitising dyes into photographic layers consists of dissolving the additive in an appropriate organic solvent for example methyl alcohol, ethyl alcohol or acetone, and adding the resulting solution to an aqueous photographic coating composition. Whilst this method has provided a commercially feasible means for incorporating optical sensitising dyes and other water insoluble photographic additives into photographic layers, and in particular silver halide emulsions, it still requires considerable care and extra manipulative steps in adjusting the volume of solvent to quantities compatible with the particular emulsion to produce the desired results. Also it is well known that excessive solvent engenders disadvantageous diffusion or wandering of the additives in the layers. If this excessive solvent is removed before coating this requires a costly and hazardous process.

The present invention provides a method of incorporating photographic additives and in particular water-insoluble additives into photographic layers of photographic material.

In a method for preparing photographic material which comprises at least one silver halide emulsion layer and optionally other layers, all coated on a photobase there are provided the steps for preparing at least one layer of the photographic material which comprise adding to an aqueous photographic colloid coating composition a solid photographic additive composition in tablet form which comprises a compressed homogeneous mixture of a finely-divided water-soluble photographically inert solid and at least one finely-divided solid photographic additive, the photographic additive or additives constituting from 1 to 5% by weight of the tablet, and coating the aqueous photographic colloid coating composition when the tablet has dissolved as a layer on a photobase and drying the coated layer. It is required that the water-soluble solid should have no adverse photographic effect. Preferably the solid should yield a colourless solution. The solid must be water-soluble, that is to say, soluble to the extent of at least 3g/liter water.

By 'compressed' means that the homogeneous mixture of solids has been compressed to the extent of at least 0.1 tons per square inch to form a tablet.

By 'finely divided' means that the average particle size of the solid is at most 400 microns.

The size of the tablet affects the rate of disolution of the tablet and thus the size can vary. However useful sizes of tablets are in the range of 0.1 cc to 1.0 cc.

The amount of compression used to produce the tablet also affects the rate of dissolution of the tablet however to a lesser degree. A compression of 0.1 tons per square inch is the minimum compression required to form a tablet which does not break down when handled. Preferably a higher compression is used e.g. over 2 tons per square inch. Useful compression forces are with the range of 0.25 tons to 10 tons per square inch.

Preferably there is present in the tablet a finely divided solid wetting agent. This wetting agent may act not only to help disperse the additive in the aqueous colloid coating solution but also as a lubricant in the preparation of the tablet. Examples of such dual purpose wetting agents are sodium lauryl sulphate and the sodium salt of di-isobutylnaphthalene sulfonic acid. The preferred amount of wetting agent present in the tablet is from 1 to 10% by weight of the tablet. If the wetting agent used does not act as a lubricant preferably there is also present in the tablet a water-soluble lubricant for example a polyethyleneglycol of the molecular weight of about 6000 or sodium benzoate. The use of a wetting agent in the tablet is especially preferred when the photographic additive is water-insoluble. In fact the method of the present invention is of particular use when the photographic additive is water-insoluble but it can be used when the photographic additive is water-soluble.

Therefore in a preferred aspect of the present invention there is provided a process for the preparation of photographic material which comprises the steps of forming photographic additive tablets by forming a homogeneous mixture of a finely divided water-soluble photographically inert solid, at least one finely divided water-insoluble photographic additive and a finely divided solid wetting agent, grinding the mixture to form a free flowing powder, compressing the powder to form tablets, each tablet containing the same amount of additive or additives and from 1 to 50% by weight of the photographic additive or additives, then adding the requisite number of tablets to an aqueous photographic colloid coating composition, coating the coating composition as a layer on a photographic base and drying.

In an alternative method according to this aspect of the present invention the finely divided solids are made into a paste which is dried and then compressed for form tablets.

Therefore there is provided a process for the preparation of photographic material which comprises the steps of forming photographic additive tablets by making a mixture of a finely divided water-soluble photographically inert solid, at least one finely divided water-insoluble photographic additive optionally a finely divided solid wetting agent, a finely divided paste-forming binder and water, forming a paste of the mixture, noodling the paste, drying the noodles and compressing the dried noodles to at least 0.1 tons per square inch to form tablets each tablet containing the same amount of additive or additives and from 1 to 50% by weight of the photographic additive or additives, then adding the requisite number of tablets to an aqueous photographic colloid coating composition allowing the tablets to dissolve and coating the aqueous coating composition as a layer on photographic base and drying the coated layer. Preferably the paste is noodled by passing it through a sieve to form short noodles which break up further when dried. Such noodles however tend to be free flowing when present in a hopper attached to a tabletting machine.

Preferably in this method the tablet as prepared and used comprises from 35 to 85% by weight of water-soluble solid, from 5 to 50% by weight of photographic additive or additives, from 0 to 15% by weight of wetting agent and from 1 to 5.0% by weight of paste-forming binder. There may also be present from 0.5 to 5.0% by weight of a water-soluble lubricant.

Examples of paste-forming binders are gelatin and carboxy methyl cellulose.

Surprisingly it has been found that when the tablets containing the photographic additive or additives are added to the photographic coating composition, the tablets dissolve at a controlled rate causing the photographic additive to be dispersed in the coating composition in such a way that it does not precipitate nor coagulate in the coating composition. But when water insoluble photographic additives in finely divided form are added alone or in mere admixture with a water-soluble solid to a photographic coating composition when they tend to precipitate or coagulate and are not dispersed in the coating composition evenly so that the dried layer does not contain the additive in a useful form. However when the additive is added with the water-soluble solid in tablet form the fact of dissolution of the tablet seems to cause the additive to disperse in the aqueous coating composition in a correct manner so that when the dried layer is formed the additive is present in the layer in a photographically useful form. The presence of a wetting agent in the tablet helps this dispersion of the additive when the tablet dissolves.

The lubricant only helps to prepare the tablets.

The process of the present invention is of particular use when the photographic colloid coating composition is an aqueous gelatino silver halide emulsion coating composition. When the photographic colloid coating composition is a silver halide emulsion, examples of water insoluble additives which are often required to be added thereto are optical sensitizers, stabilizers, antifoggants, colour couplers and acutance dyes. All of these are usually water-insoluble. Further additives which can be used are hardeners, optical brightening agents or coating aids.

The invention is particularly useful when the additive is an optical sensitizing dye. Most optical sensitizing dyes are highly water-insoluble, although a few can be said to be sparingly water soluble. Optical sensitizing dyes are usually added to aqueous silver halide emulsions, for adsorption on to silver halide crystals, by dissolving them in ethanol or other simple alcohols, adding the alcoholic solution to the emulsion and then either leaving the alcohol in the aqueous silver halide emulsion or removing the alcohol, which is difficult. However if there is already present in the silver halide emulsion colour couplers dissolved in oil dispersions often the alcohol leaches out the colour couplers from the dispersion causing the colour couplers to crystalize. Also the need to produce very concentrated silver halide emulsion for coating by high speed processes such as cascade coating means that the emulsion should not be diluted by the addition of sensitizing dyes dissolved in solvents such as alcohol. However by means of the process of the present invention it is possible to add optical sensitizing dyes in a highly concentrated form to aqueous silver halide emulsions. When the optical sensitizing dye is added to the silver halide emulsion in the tablets the solid dissolves in the aqueous emulsion and the dye is dispersed throughout the emulsion in such a form that it can become adsorbed by the silver halide crystals.

Alternatively in the process of the present invention the photographic colloid coating composition forms a layer which is a non-light-sensitive colloid layer, preferably a gelatin layer, which may be an inter-layer between emulsion layers, a super-coat layer, an underlayer or a backing layer. If the colloid layer is a supercoat layer the additive may be for example an optical brightening agent or a U.V. Absorber. If the colloid layer is an inter-layer the additive may be for example a filter dye. If the colloid layer is an under layer the additive may be for example, a bleachable anti-halation dye. If the colloid layer is the backing layer the additive may be for example an anti-halation dye.

Suitable water-soluble organic compounds of use in preparing the photographic additive tablet used in the process of the present invention belong to the following classes of compounds:-

(a) derivatives, particularly alkyl derivatives, of urea and thiourea, preferably those of the formula

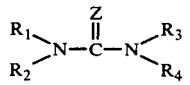

wherein $R_1$, $R_2$, $R_3$ and $R_4$ each independently represent alkyl having 1–4 carbon atoms, optionally substituted by hydroxyl, cycloalkyl or phenyl; tolyl, which is optionally substituted with OH-groups; and wherein $R_1$, $R_2$ and $R_3$ can also be hydrogen; and Z represents oxygen or sulphur. The following examples may be given: N-ethylurea, N-butylurea; N-(3-tolyl)-urea, N,N'-dimethylurea, N,N'-bis-(hydroxy-methyl)-urea, N,N'-ethyleneurea, N-methylthiourea, N,N'-dimethylthiourea, N-ethyl-N-phenylurea and N-hydroxymethylurea.

(b) saturated and unsaturated mono- and dicarboxylic acid amides, particularly those of formula $$R—CO—NH_2 \text{ or } R—(CONH_2)_2$$

wherein R represents an alkyl or alkylene radical having 1–6 carbon atoms, or the group —CH=CH—, $CH_2$=CH— or $CH_3CH$=CH—, also phenyl or tolyl, also heterocyclic saturated and/or unsaturated 5- or 6-membered ring having at least one N, O, S, CO or NH in the ring, whereby the symbol R can optionally be substituted also by OH, $NH_2$, halogen or hydroxyalkyl having 1–3 carbon atoms. These acid amides are, for example, acetamide, chloroacetamide, nicotinic acid amide and benzamide.

(c) lactams such as δ-valerolactam, ε-caprolactam and oenantholactam;

(d) acid imides or derivatives of acid imides, especially those of the general formula

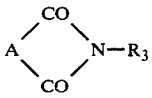

wherein A represents —CH=CH— or $(CH_2)_n$, wherein n is 1–6, and A can optionally be substituted by OH, $NH_2$ halogen, hydroxyalkyl ($C_1$–$C_3$) groups, and $R_3$ represents H, OH or hydroxyalkyl ($C_1$–$C_3$), examples of these are: succinimide, maleinimide and N-hydroxysuccinimide;

(e) oximes such as acetoneoxime, cyclohexanoneoxime and diacetylmonoxime;

(f) saturated and unsaturated 5- or 6- membered heterocyclic compounds which contain in the ring O, S, CO and NH, and which can optionally be substituted with OH, $NH_2$, halogen, alkyl ($C_1$–$C_4$), phenyl, hydroxyalkyl ($C_1$–$C_3$) — groups, such as symmetrical trioxane, imidazole, 2-methylimidazole, pyrazole, pyrazine, 2,3-dimethyl-1-phenyl-5-pyrazolone, and 1,2,4-triazole;

(g) aliphatic or aromatic, at least bivalent alcohols, such as 2,2-dimethyl- and 2,2-diethylpropanediol-1,3; dihydroxyacetone, o-xylylene glycol, erythrite, D-fructose, maltose, lactose, xylite, sorbitol and mannitol;

(h) polyalkylene glycols, such as polyethylene glycol preferably having a molecular weight 1,000 to 20,000, especially those of the formula

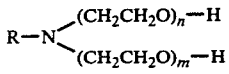

wherein R represents a saturated or unsaturated alkyl radical having 9 to 30 carbon atoms, and n and m each represents the numbers 3 to 200;

(i) carbamic acid esters, such as carbamic acid methyl ester, carbamic acid ethyl ester, and carbamic acid propyl ester.

(j) derivatives of benzene, particularly those of the general formula

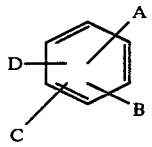

wherein A, B, C and D each independently represent OH, halogen, alkyl, hydroxyalkyl and alkoxy having 1 to 3 carbon atoms; and wherein A, B and C can be hydrogen; the following may for example be mentioned: 1,4-dihydroxybenzene, 2,6-dihydroxytoluene, 2,3-dihydroxytoluene, 2,4-dimethyl-1,5-dihydroxybenzene, 4,5-dimethyl-1,2-dihydroxybenzene, 3,5-dimethyl-1,2-dihydroxybenzene, 1,2-bis-(hydroxymethyl)-benzene, 1,3-bis(hydroxymethyl)-benzene), 1,4-bis-(hydroxymethyl)-benzene, 2-chloro-1,4-dihydroxybenzene, 4-chloro-1,2-dihydroxybenzene, 1-chloro-2,4-dihydroxybenzene, 1-chloro-3,5-dihydroxybenzene, 1-chloro-2,5-dimethyl-4-hydroxybenzene and 1-chloro-4,5-dimethyl-2-hydroxybenzene.

The most preferred classes of compounds of use in the present invention are the aliphatic at-least-bivalent alcohols of (g).

Two compounds of especial use are lactose and sorbitol. Both of these compounds can be considered as very water-soluble, sorbitol having a water solubility of 830g/liter at 20° C. and lactose 170 g/liter at 20° C.

Suitable inorganic salts are water-insoluble colourless salts which produce a neutral pH solution when dissolved for example salts of the alkaline metals or ammonium such as sodium chloride, potassium sulphate and ammonium nitrate.

As stated preferably there is present in the photographic additive tablet used in the present invention a solid wetting agent which may be of an anionic and/or non-ionic nature. The presence of the wetting agent tends to improve the dispersibility of the optical sensitizing dye or other photographic additive in the aqueous colloid coating composition.

The non-ionic surfactants of use are, in particular, polyglycol ethers such as alkyl-polyglycol ether or alkylphenylpolyglycol ether, for example, octylphenylpolyglycol ether and fatty acid polyglycol esters. Suitable anionic surfactants are, e.g. the most varied sulphates, for example, sulphated primary aliphatic alcohols having 10 to 18 carbon atoms, such as sodium decyl sulphate, sodium lauryl sulphate, sodium myristyl sulphate and sodium oleyl sulphate or sulphated secondary aliphatic alcohols; also sulphated unsaturated fatty acids, fatty acid polyglycol ethers or sulphated fatty acid amides, sulphated alkyleneoxy adducts, sulphated partially esterified polyvalent alcohols; and, in particular, the sulphonates such as alkylsulphonates, for example, laurylsulphonate, cetylsulphonate, stearylsulphonate, petroleum sulphonates, napthenesulphonates, olefinsulphonates, mersolates, sodium dialkylsulphosuccinates such as sodium dioctylsulphosuccinate and taurides, for example, oleyl methyl tauride (sodium salt), alkylarylsulphonates such as alkylbenzenesulphonates having a straight-chain or branched alkyl chain containing about 7 to 20 carbon atoms and mono- and dialkylnaphthalenesulphonates such as nonylbenzenesulphonate, dodecylbenzene-sulphonate and hexadecylbenzenesulphonate, as well as 1-isopropylnaphthalene-2-sulphonate, di-iso-propylnaphthalenesulphonate, di-n-butylnaphthalenesulphonate, di-iso-butylnaphthalenesulphonate; condensation products from naphthalenesulphonic acid and formaldehyde, such as dinaphthylmethanedisulphonate, also lignin sulphonates and oxylignin sulphonates, sulphonates of polycarboxylic acid esters and polycarboxylic acid amides, and condensation products of fatty acids with aminoalkylsulphonates, also phosphated surfactants such as mono- and diphosphate esters of oxethylated fatty alcohols, alkylphenols and fatty acids.

The process of the present invention is of particular use in dispersing optical sensitising dyes in photographic emulsions and therefore according to an especially preferred aspect of the present invention there is provided a process for the preparation of photographic material which comprises the steps of forming a photographic additive tablet which comprises a compressed homogeneous mixture of a finely-divided water-soluble photographically inert solid and at least one optical sensitizing dye, the optical sensitizing dye or dyes constituting from 1 to 50% by weight of the tablet, adding the requisite number of tablets so formed to an aqueous silver halide emulsion, coating the emulsion as a layer on photographic base and drying the composition.

This process is applicable to optical or spectral sensitising dyes which are soluble in water as well as those which are substantially insoluble in aqueous solution. Substantially insoluble refers to sensitising dyes which have a solubility in water (at 20° C.) of less than 0.1 per cent by weight. Among the useful optical sensitising dyes are the cyanine dyes, the hemicyanine or merocyanine dyes and the styryl dyes and oxonol dyes and other dyes containing the amidinium ion auxo-chromophore system, such as rhodamine, pinacyanol and pinaflavol. Preferably in this aspect of the present invention there is present in the tablet up to 10% by weight of a wetting agent. When substantially water-insoluble optical sensitizing dyes are added to an aqueous silver halide emulsion in the form of a tablet the water-soluble solid slowly dissolves, causing the optical sensitizing dye to disperse in such a form that it absorbs on to the silver halide crystals, dyeing the silver halide uniformly and thus optically sensitizing it.

As hereinbefore stated the process of this invention can also be used for other dyes, colourants, antifoggants, stabilisers, colour couplers, hardeners, optical brighteners and coating aids which are difficultly soluble in conventional solvents, and to other photographic additives which despite being soluble in conventional solvents are desired to be formed into higher concentration solutions then is possible by use of the conventional solvents.

The photographic layer prepared in the process of the present invention is usually a photosensitive silver halide layer but it may be for example a supercoat or protective layer, an inter-layer and in particular a filter layer, an undercoat layer or a backing layer. If the layer prepared is a silver halide layer this layer may comprise any silver halide composition for example silver chloride, silver bromide, silver iodide and mixed halide such as chlorobromide and iodobromide. The silver halide layers may of course contain other additives for example chemical sensitizers such as noble metals, sulphur compounds and polyalkylene oxides, coating aids and sequestering agents.

The photographic material produced by the process of the present invention may be any photographic material for example black and white camera film and graphic arts films, black and white paper, colour films and paper and X-ray films.

The following Examples will serve to illustrate the invention but do not limit the scope thereof.

EXAMPLE 1

A gold sensitised silver iodo-bromide gelatino emulsion containing 8.8 mole % of silver iodide was stabilised with an aqueous solution of 4-hydroxy-6-methyl-1,3,3a-7-tetrazaindene and divded into two portions. Each portion of emulsion was spectrally sensitised, using the mixture of sensitisers of the formulae (101) and (102) in the ratio 2 parts (101) to 1 part (102).

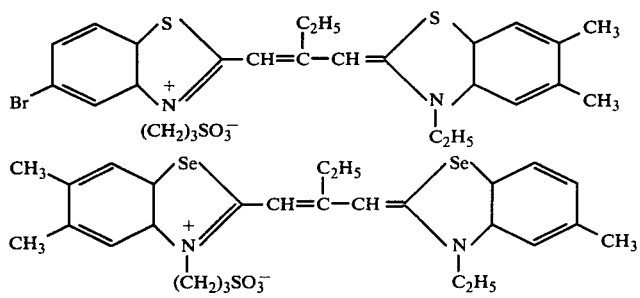

(a) 20 mg of the mixture of the sensitizers was ground together with 340 mg of sorbitol and 40 mg of sodium lauryl sulphate in a ball mill. The ground mixture was then pressed to a tablet of 13 mm in diameter at a pressure of 6 tons. The tablet was added to 100 g of the above mentioned emulsion and the emulsion stirred at 40° C. for 15 minutes to prepare sample (a).

(b) To 20 mg of the mixture of the sensitizers, was added ethanol to form a dye solution. The amount of ethanol required to completely dissolve the dye was 39 ml. This dye solution was added to 100 g of the second portion of the above mentioned emulsion to prepare a control sample (b). To each emulsion portion was added a phenolic cyan dye forming coupler dispersed in a high boiling solvent.

The coupler used was 2-{4-[2,4-Bis(1,1-dimethylpropyl)phenoxy]butylcarbamoyl}-1-naphthol in tritolyl phosphate at a ratio of coupler to oil of 1:1. The coupler was added to the emulsion at the rate of 1 g of coupler per 2 g of silver.

The emulsion portions were then coated on a support base. These photographic coatings were exposed for 1/30th second through an ILFORD 204 filter and processed by a colour negative process which comprises a developing solution, a bleaching solution, a fixing solution and a stabilising solution.

The process used is as follows:

| Developer Constituents | Fresh Tank Solution Formulation |
|---|---|
| Water at 21° C.to 27° C. | 800 ml |
| Potassium Carbonate (Anhydrous) | 37.5 g |
| Sodium Sulphite (Anhydrous) | 4.25 g |
| Potassium Iodide | 2.0 mg |
| Sodium Bromide | 1.3 g |
| Hydroxylamine Sulphate | 2.0 g |
| Sodium hexametaphosphate | 2.5 g |
| 4-amino-3-methyl-N-ethyl-N-hydroxyethyl anilino-hydrogen sulphate | 4.75 g |
| Water to make | 1 liter |
| pH at 27° C. | 10.00 ± 0.03 |

| Bleach Constituents | Fresh Tank Solution Formulation |
|---|---|
| Water at 21° C.to 27° C. | 600 ml |
| Ammonium Bromide | 150 g |
| Ferric Ammonium E.D.T.A. (1.56 molar) | 175 ml |
| Acetic Acid (GLACIAL) | 10.5 ml |
| Sodium Nitrate | 35 g |
| Water to make | 1 liter |
| pH at 27° C. | 6.00 ± 0.20 |

| Fixer Constituents | Fresh Working Solution Formulation |
|---|---|
| Water at 21° C.to 27° C. | 800 ml |
| Ammonium Thiosulphate (50% soln.) | 162 ml |
| Ethlenedinitrilo Tetraacetic Acid Disodium Salt | 1.25 g |
| Sodium Bisulphite (Anhydrous) | 12.4 g |
| Sodium Hydroxide | 2.4 g |
| Water to make | 1 liter |
| pH at 27° C. | 6.50 ± 0.20 |

| Stabiliser Constituents | Fresh Working Solution Formulation |
|---|---|
| Water at 21° C.to 27° C. | 800 ml |
| Formalin (37% solution) | 5.0 ml |
| Wetting agent | 0.8 ml |
| Water to make | 1 liter |

The process is carried out as follows:

| Solution/Procedure | Remarks | Temp. ° C. | Time in Mins |
|---|---|---|---|
| 1 Developer | Total Darkness | 37.8 ± 0.2 | 3¼ |
| 2 Bleach | Total Darkness | 37.8 ± 3 | 6½ |
| 3 Wash | Room Lighting | 37.8 ± 3 | 3¼ |
| 4 Fixer | Room Lighting | 24 – 41 | 6½ |
| 5 Wash | Room Lighting | 37.8 ± 3 | 3¼ |
| 6 Stabiliser | Room Lighting | 24 – 41 | 1½ |
| 7 Dry | Room Lighting | 24 – 41 | 10–20 |

The following results were obtained.

TABLE 1

| | Speed | Fog | Sens Max. nm. |
|---|---|---|---|
| a) Present invention | 100 | .15 | 650 |

TABLE 1-continued

| | Speed | Fog | Sens Max. nm. |
|---|---|---|---|
| b) Control | 100 | .15 | 650 |

Table 1 shows that saple (a) according to the process of the present invention is by no means inferior to the control. (b) However far better coating quality was obtained using the present invention because the presence of alcohol causes local dehydration which results in particulate matter, which is difficult to redisperse. This particulate matter remains in the composition causing coating defects such as streaks and spots. Such streaks were observed in sample (b) but none in sample (a).

EXAMPLE 2

Two further portions of the emulsion used in Example 1 were treated in entirely the same manner as in Example 1, except that one portion was spectrally sensitized by addition of a mixture of sensitizers of formulae (103), (104) and (105) in the ratio 6 parts (103) to 3 parts (104) to 1 part (105).

In sample (d) 20 mg of the mixture of the sensitizers was ground together with 340 mg of sorbitol and 40 mg of sodium lauryl sulphate in a ball mill. The ground mixture was then mixed with 40 mg 10% gelatin solution. The resulting paste was noodled by passing through a sieve with 1 mm diam. holes. The noodles were dried in warm air and then compressed to a tablet of 13 mm diam. The tablet was added to 100 g of the above mentioned emulsion and the emulsion stirred at 40° C. for 15 mins to prepare Sample (d).

In sample (e) 20 mg of the mixture of the sensitizers was dissolved in 39 ml of ethyl alcohol.

(103)

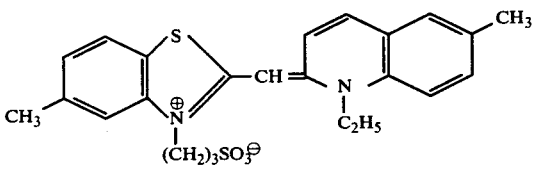

(104)

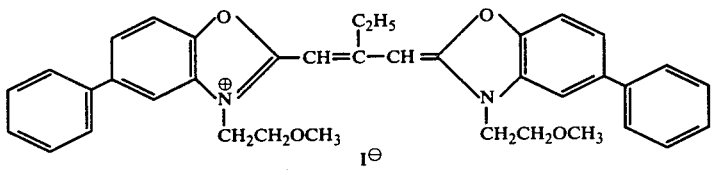

(105)

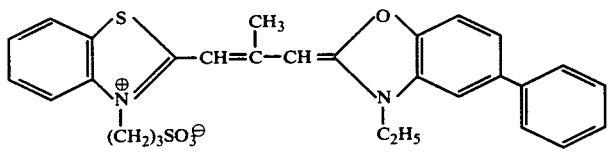

The results were as shown in table 2.

TABLE 2

| | Sample | Speed | Fog | Sens Max. |
|---|---|---|---|---|
| d) | Present process | 100 | .18 | 530 & 550 |
| e) | Conventional process | 100 | .18 | 530 & 550 |

As can be seen from Table 2 no difference exists in photographic properties between the present invention and the conventional process. However the method of the invention gave better coating quality.

EXAMPLE 3

This example serves to show the use of the present invention for introducing additives other than optical sensitizing dyes into photographic material. The additive used is a photographic silver halide emulsion stabilizer 4-hydroxy-6-methyl-1,3,3a,7-tetraazaindene.

Often it is desired that concentrated aqueous solutions of photographic additives are prepared in bulk and stored and then added to the silver halide emulsion whilst the emulsion is being prepared. However solutions of 4-hydroxy-6-methyl-1,3,3a,7-tetraazaindene greater in strength than 1% weight per volume in water are unstable and precipitate if stored for more than three days. It is preferred to add a more concentrated aqueous solution than a 1% solution of this additive to the silver halide emulsion during preparation.

Tablets containing the additive were prepared as follows:

5 g of the additive was ground together with 10 g of sodium lauryl sulphate in a ball mill. The ground mixture was blended with 85 g of lactose using a planetary mixer. The dry powder mixture was then mixed with 10 g of 10% aqueous gelatin solution and the resulting wet mass was granulated by passing through a sieve with 2 mm mesh. The granules were dried in warm air and then passed through a 1 mm mesh sieve before being compressed into 0.5 g tablets containing 5.0% additive.

The tablets could be stored without any apparent deterioration of the stabiliser.

In Example 1 as hereinbefore set forth the silver halide emulsion was stabilised with an aqueous solution of a 4-hydroxy-6-methyl-1,3,3a,7-tetrazaindene. Example 1 was repeated using instead of the aqueous solution of the stabilizer the tablets containing the stabilizer as just prepared, the same amount of stabilizer (1.3g per gram mole of silver halide) being added. The emulsion obtained was perfectly satisfactory and no change in the stabilizing effect of the stabilizer was observed.

As the composition made according to the present process is far more concentrated (at least five times) than in the case of the aqueous solution, when the stabilizer is added to the emulsion, the emulsion is not diluted as much using the present process. This means a highly concentrated light sensitive photographic emulsion layer can be coated.

What we claim is:

1. In a method for preparing photographic material which comprises at least one silver halide emulsion layer and optionally other layers, all coated on a photobase, the steps for preparing at least one layer of the photographic material which comprise adding to an aqueous photographic colloid coating composition a solid photographic additive composition in tablet form which comprises a compressed homogeneous mixture of a finely-divided water-soluble photographically inert solid which is a derivative of urea or thiourea, a saturated or unsaturated mono- or dicarboxylic acid amide, a lactam, an acid imide or derivative thereof, an oxime, a saturated or unsaturated 5- oder 6-membered heterocyclic compound which contains in the ring O, S, CO and NH, and which can optionally be substituted with OH, $NH_2$, halogen, alkyl ($C_1$–$C_4$), phenyl, hydroxyalkyl ($C_1$–$C_3$) groups, an aliphatic or aromatic, at least bivalent alcohol, a polyalkylene glycol, a carbamic acid ester, or a derivative of benzene, 1 to 50% by weight of the tablet of at least one finely-divided solid photographic additive and 1 to 10% of a finely divided solid wetting agent, and coating the aqueous photographic colloid coating composition when the tablet has dissolved as a layer on a photobase and drying the coated layer.

2. A method according to claim 1 wherein the size of the tablet is from 0.1 to 1.0 cc.

3. A method according to claim 1 wherein the compression used to prepare the tablet is from 0.25 to 10 tons per square inch.

4. A method according to claim 1 wherein there is present in the tablet also a lubricant.

5. A method according to claim 1 which comprises the steps of forming a homogeneous mixture of the finely divided water-soluble photographically inert solid, at least one finely divided water-insoluble photographic additive and the finely divided solid wetting agent, grinding the mixture to form a free flowing powder, compressing the powder to form tablets, each tablet containing the same amount of additive or additives and from 1 to 50% by weight of the photographic additive or additives, then adding the requisite number of tablets to an aqueous photographic colloid coating composition, allowing them to dissolve and coating the coating composition as a layer on a photographic base and drying the coated layer.

6. A method according to claim 1 which comprises the steps of forming a mixture of 35 to 85% by weight of a finely divided water-soluble photographically inert solid, 5 to 50% by weight of at least one finely divided water-soluble photographic additive, 0 to 15% by weight of a finely divided solid wetting agent, 1 to 5% by weight of a finely divided paste-forming binder and water, forming a paste of the mixture, noodling the paste, drying the noodles and compressing the dried noodles to at least 0.1 tons per square inch to form tablets each tablet containing the same amount of additive or additives then adding the requisite number of tablets to an aqueous photographic colloid coating composition allowing the tablet to dissolve and coating the aqueous coating composition as a layer on photographic base and drying the coated layer.

7. A method according to claim 6 wherein the paste is noodled by passing it through a sieve to form short noodles.

8. A method according to claim 6 wherein the tablets as prepared in addition comprise from 0.5 to 5.0% by weight of a water-soluble lubricant.

9. A method according to claim 6 wherein the paste-forming binder is gelatin or carboxymethyl cellulose.

10. A method according to claim 1 wherein the layer prepared in the photographic material is a silver halide emulsion layer.

11. A method according to claim 10 wherein the photographic additive is a stabilizer, anti-foggant, colour coupler or acutance dye, hardener, optical brightening agent, coating aid or optical sensitising dye.

12. A method according to claim 11 wherein the photographic additive is an optical sensitising dye which comprises the steps of forming a photographic additive tablet which comprises a compressed homogeneous mixture of a finely-divided water-soluble photographically inert solid and at least one optical sensitizing dye, the optical sensitizing dye or dyes constituting from 1 to 50% by weight of the tablet, adding the requisite number of tablets so formed to an aqueous silver halide emulsion allowing the tablets to dissolve and coating the emulsion as a layer on photographic base and drying the composition.

13. A method according to claim 1 wherein the layer prepared in the photographic material is a non-light sensitive colloid layer.

14. A method according to claim 13 wherein the non-light sensitive colloid layer is a gelatin layer which is present in the photographic material as an inter-layer between silver halide emulsion layers, as a super-coat layer, as an under-layer or as a backing layer.

15. A method according to claim 1 wherein the photographically inert solid is 2,2-dimethyl- and 2,2-dialkylpropane-diol-1,3, dihydroxyacetone, o-xylylene glycol, erythrite, D-fructose, maltose, xylite, lactose, sorbitol or mannitol.

16. A method according to claim 15 wherein photographically inert solid is lactose or sorbitol.

17. A method according to claim 1 wherein the finely divided water-soluble photographically inert solid is a salt of an alkaline metal or ammonium.

18. A method according to claim 1 wherein the wetting agent is a non-ionic surfactant.

19. A method according to claim 18 wherein the non-ionic surfactants are alkyl-polyglycol ethers, alkylphenyl polyglykol ethers or fatty acid polyglycol esters.

20. A method according to claim 1 wherein the wetting agent is an anionic surfactant.

21. A method according to claim 20 wherein the anionic surfactants are sulphated primary or secondary aliphatic alcohols having 10 to 18 carbon atoms, sulphated unsaturated fatty acids, fatty acid polyglycol esters or sulphated fatty acid amides, sulphated alkyleneoxy adducts, sulphated partially esterified polyvalent alcohols, alkylsulphonates, naphthalenesulphonates, olefinsulphonates, mersolates, sodium dialkylsulphosuccinates, taurides, alkylarylsulphonates, mono- and dialkylnaphthalenesulphonates, condensation products from naphthenesulphonic acid and formaldehyde, lignin sulphonates and oxylignin sulphonates, sulphonates or polycarboxylic acid esters and polycarboxylic acid amides, condensation products of fatty acids with aminoalkylsulphonates, and phosphated surfactants.

* * * * *